US010408439B2

(12) United States Patent
Brennan

(10) Patent No.: US 10,408,439 B2
(45) Date of Patent: Sep. 10, 2019

(54) TIKI TORCH HOLDER KIT

(71) Applicant: Patrick Kelly Brennan, Bradenton, FL (US)

(72) Inventor: Patrick Kelly Brennan, Bradenton, FL (US)

( * ) Notice: Subject to any disclaimer, the term of this patent is extended or adjusted under 35 U.S.C. 154(b) by 72 days.

(21) Appl. No.: 15/692,168

(22) Filed: Aug. 31, 2017

(65) Prior Publication Data

US 2019/0063732 A1 Feb. 28, 2019

(51) Int. Cl.

| | |
|---|---|
| ***E04H 12/22*** | (2006.01) |
| ***F21V 21/08*** | (2006.01) |
| ***F21L 17/00*** | (2006.01) |

(52) U.S. Cl.

CPC ..... *F21V 21/0824* (2013.01); *E04H 12/2215* (2013.01); *E04H 12/2269* (2013.01); *F21L 17/00* (2013.01)

(58) Field of Classification Search

CPC . F21V 21/0824; E04H 12/22; E04H 12/2215; E04H 12/223; E04H 12/2253; E04H 12/2261; E04H 12/2269; E04H 12/2276; E04H 12/347; A45F 3/44; F21L 17/00; E02D 5/80

USPC ..... 362/190

See application file for complete search history.

(56) References Cited

U.S. PATENT DOCUMENTS

| | | | | |
|---|---|---|---|---|
| 4,765,277 | A * | 8/1988 | Bailey | A01K 39/012 119/428 |
| D703,369 | S | 4/2014 | Jones | |
| 2011/0253876 | A1 | 10/2011 | Odell et al. | |
| 2013/0019794 | A1 | 1/2013 | Neal | |
| 2017/0089509 | A1 * | 3/2017 | Bailey | F16B 7/182 |

FOREIGN PATENT DOCUMENTS

| | | | | |
|---|---|---|---|---|
| GB | 2138048 | A * | 10/1984 | E04H 12/2215 |

* cited by examiner

*Primary Examiner* — Suezu Ellis
(74) *Attorney, Agent, or Firm* — Dunlap Bennett & Ludwig PLLC

(57) ABSTRACT

A kit of garden torch holders for securely retaining a garden torch in the ground and on the wall is provided. A first torch holder has a hollow body having a circumferential flange and a hollow tip for planting the first torch holder into the ground for retaining a shaft therein. The kit also provides wall mountable second and third torch holders providing pairs of opposing notches for mounting both the body of the garden torch and the above mentioned first torch holder.

8 Claims, 3 Drawing Sheets

TIKI TORCH HOLDER KIT

BACKGROUND OF THE INVENTION

The present invention relates to garden torches and, more particularly, to a kit of garden torch holders that securely hold garden torch pole in the ground, wherein each kit of garden torch holders may be wall mountable for off season use or storage.

Garden torches, sometimes called tiki torches, are used for nighttime illumination of gardens. Such torches are typically elevated several feet above the ground level by a shaft. These shafts, however, are sometimes difficult to push into hard soil so that the garden torch stands straight. Likewise, when the ground gets wet it may adversely affect the ability of the torch to stand upright. Relatedly, traditional garden torch shafts can be difficult to pullout from soil either for storage purposes or to relocate the garden torch. Their elongated nature also makes garden torches difficult to store in the off season.

Currently, there are stands for garden torches, but these have several disadvantages including, but not limited to, requiring metal screws to tighten to the shaft, only providing one side of the stand adapted to secure to the ground causing bending and stability issues upon planting and keeping the garden torch upright during heavy winds, respectively. Furthermore, because of these structural limitations, the use of metal screws and one-sided staking, most if not all of this current device needs to be made of metal, which are susceptible to rust.

As can be seen, there is a need for a garden torch holder that repeatedly enables a stable connection and disconnection between the shaft and the ground, be it softer sandy soils, wet soil, or any type of soil. The garden torch holder of the present invention is adapted to hold the garden torch completely around the base of the shaft, not just one side. Thereby, the garden torch holder facilitates the planting into and the pulling out of the ground, and does not require a screw to be turned at ground level to secure the torch to the holder/stand.

SUMMARY OF THE INVENTION

In one aspect of the present invention, a first torch holder includes a hollow cylindrical portion extending from a flange end to a tip end, wherein the flange end defines an opening communicating to the hollow of the hollow cylindrical portion; a flange radially extending from the flange end; a hollow conical tip portion extending from said tip end along a longitudinal axis shared with the cylindrical portion; and a plurality of ribs protruding from an inward surface of said conical tip portion, wherein the plurality of ribs is spaced apart along the inward surface thereof for frictionally engaging and supporting a shaft of a torch in an upright orientation.

In another aspect of the present invention, a kit for holding garden torches in a vertical supporting surface and a horizontal supporting surface includes the first torch holder; and a second torch holder providing: a second mounting portion; at least one pair of upward notch arms extending from the second mounting portion, each upward notch arm providing at least two spaced apart upward notches so that each pair of upward notch arms provides a plurality of pairs of upward notches, wherein each pair of upward notches is dimensioned to slidably receive a conical base portion of a garden torch; a retainer arm extending from said mounting portion; and a plurality of protrusions extending upwardly from the retainer arm.

In yet another aspect of the present invention, a kit for holding garden torches in a vertical supporting surface and a horizontal supporting surface includes third torch holder providing: a third mounting portion; a plurality of pairs of lateral notch arms extending from the third mounting portion, each lateral notch arm providing an upper flange perpendicularly extending from an upper portion thereof; and each upper flange providing a plurality of lateral notches so that each pair of lateral notch arms provides a plurality of pairs of facing lateral notches.

These and other features, aspects and advantages of the present invention will become better understood with reference to the following drawings, description and claims.

DETAILED DESCRIPTION OF THE INVENTION

Figure 1:
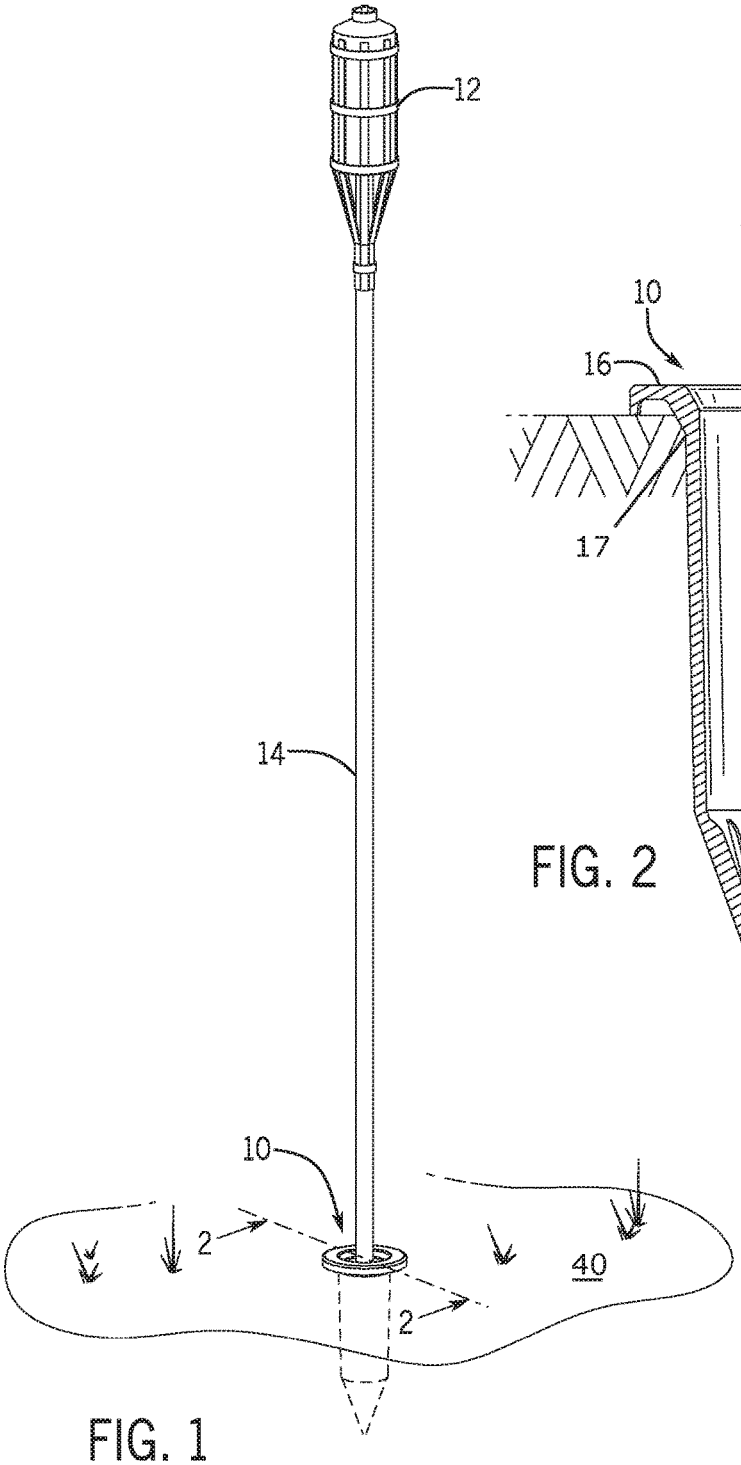
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a kit of garden torch holders for securely retaining a garden torch in the ground and on the wall. A first torch holder has a hollow body having a circumferential flange and a hollow tip for planting the first torch holder into the ground for retaining a shaft therein. The kit also provides wall mountable second and third torch holders providing pairs of opposing notches for mounting both the body of the garden torch and the above mentioned first torch holder.

It should be understood by those skilled in the art that the use of directional terms such as upper, lower, upward, downwardly, inward, inner and the like are used in relation to the illustrative embodiments as they are depicted in the figures, the upward direction (or upper) being toward the top of the corresponding figures and a downward direction being toward the bottom of the corresponding figure.

Referring to FIGS. 1 through 6, the present invention may include a first torch holder 10 for removably securing a garden torch 12 via its shaft 14 to a horizontal supporting surface 40, such as the ground. The present invention also may embody a second and third torch holder 24 and 32 for removably securing the garden torch 12 via its base 50 to a vertical supporting surface 42, such as a wall. Each holder 10, 24, and 32 may be made of material that can be repeatedly bent without fracturing and is not susceptible to rusting, such as various plasticized materials and the like that can be fabricated via injection molding, additive manufacture and the like.

Figure 2:
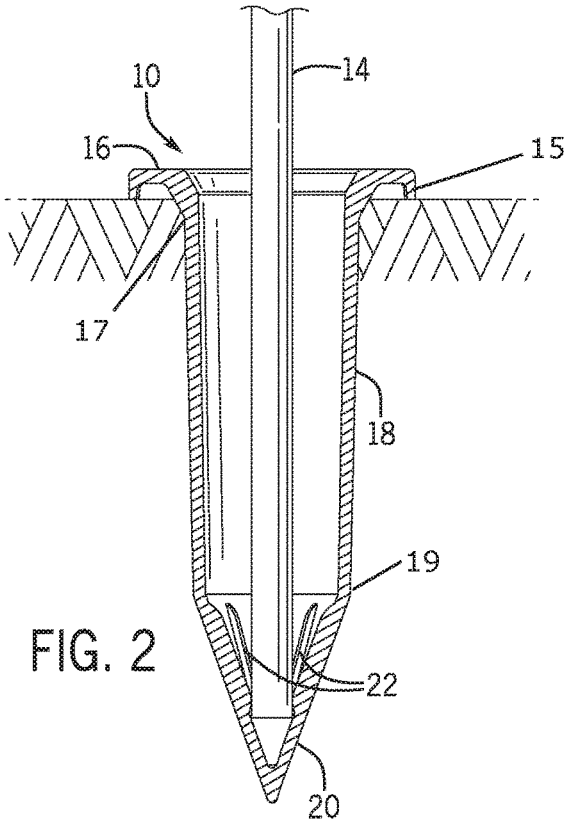
FIG. 2 is a cross-sectional view of an exemplary embodiment of the present invention taken along line 2-2 of FIG. 1.

The first torch holder 10 may have a hollow cylindrical portion 18 that extends between a flange end 17 to a tip end 19. A flange 16 may radially extend from a circumference of the flange end 17. The flange 16 provides a surface area for a user to apply downward pressure along the first torch holder 10 for submerging it into the horizontal supporting surface 40, while still maintaining an opening 44 communicating to the hollow of the cylindrical portion 18. The flange 16 may provide a flange ridge 15 for engaging the horizontal supporting surface 40 when the remaining portions of the first torch holder 10 have penetrated said horizontal supporting surface 40. The flange ridge 15 may extend perpendicularly from a distal end of the flange 16, as illustrated in FIG. 2.

A hollow conic tip 20 may extend from the tip end 18 along a shared longitudinal axis of the conic tip 20 and the cylindrical portion 18, wherein the conic tip 20 is adapted to penetrate the horizontal supporting surface 40. The conic tip 20 may provide inward-facing ribs 22 protruding into its hollow space, wherein the ribs 22 are adapted to frictionally engage the surface of the shaft 14 slid into the hollow space, as illustrated in FIG. 2.

Figure 4:
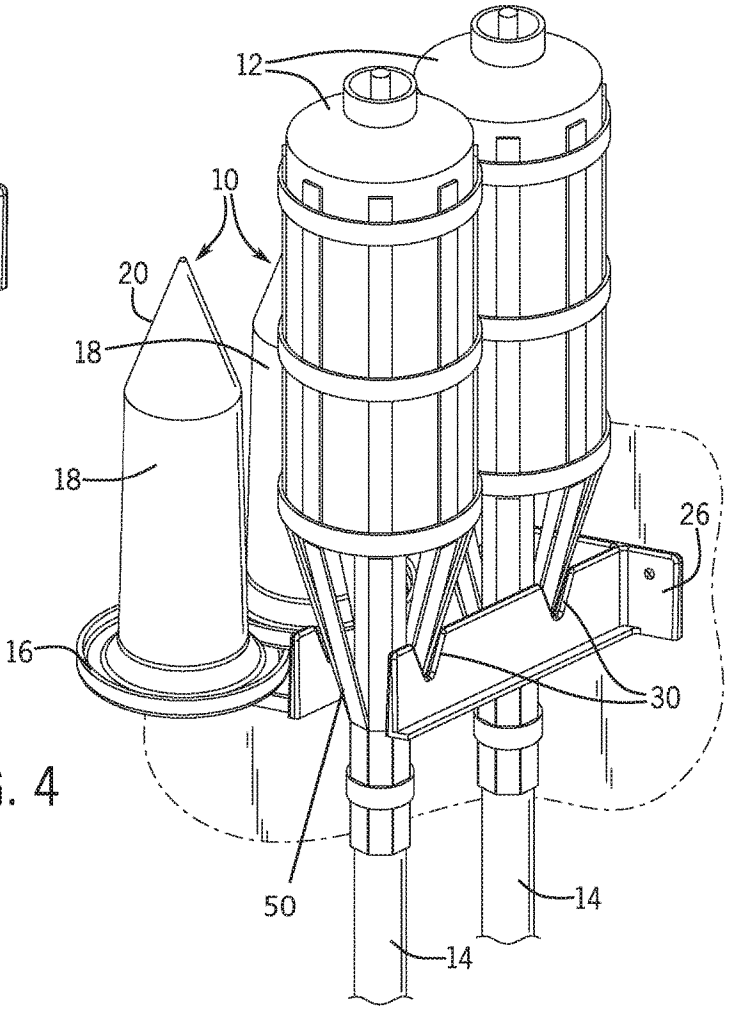
FIG. 4 is a section view of an exemplary embodiment of the present invention, showing the first storage rack in use.
Figure 3:
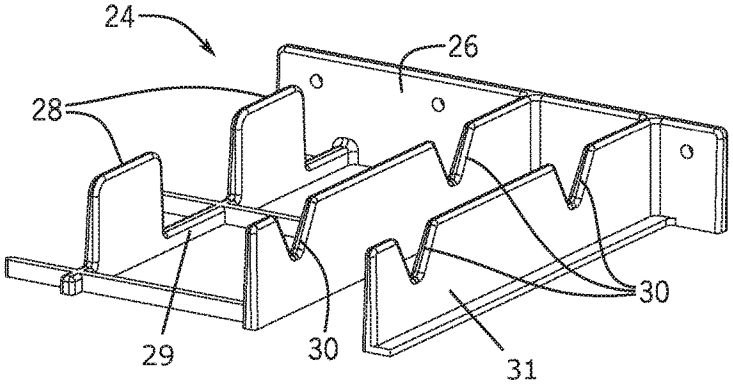
FIG. 3 is a perspective view of an exemplary embodiment of a first storage rack of the present invention.

The second and third torch holder 24 and 32 may provide a planar mounting component 26 and 36, respectively, adapted to mount to the vertical supporting surface 42; in certain instances, by providing fastener holes or the like. The second torch holder 24 may provide a plurality of notch arms 31 and retainer arms 29 extending generally perpendicularly from the planar mounting component 26, as illustrated in FIG. 3. Each notch arm 31 may provide a plurality of spaced apart V- or U-shaped upward-facing notches 30 cut into each arm 31 so that the notches 30 align with notches 30 on an adjacent arm 31. Thereby these pairs of aligned upward-facing notches 30 are dimensioned and adapted to engage opposing sides of a conic base 50 of the torch 12 for removably retaining said torch 12 in a stored condition, as illustrated in FIG. 4. Each retainer arm 29 provides a plurality of spaced apart of protrusions 28, each protrusion 28 may be dimensioned and adapted to slide into the opening 44 and snugly engage the inner walls of the cylindrical portion 18, retaining the first torch holder 10 in a stored condition, as illustrated in FIG. 4.

Figure 6:
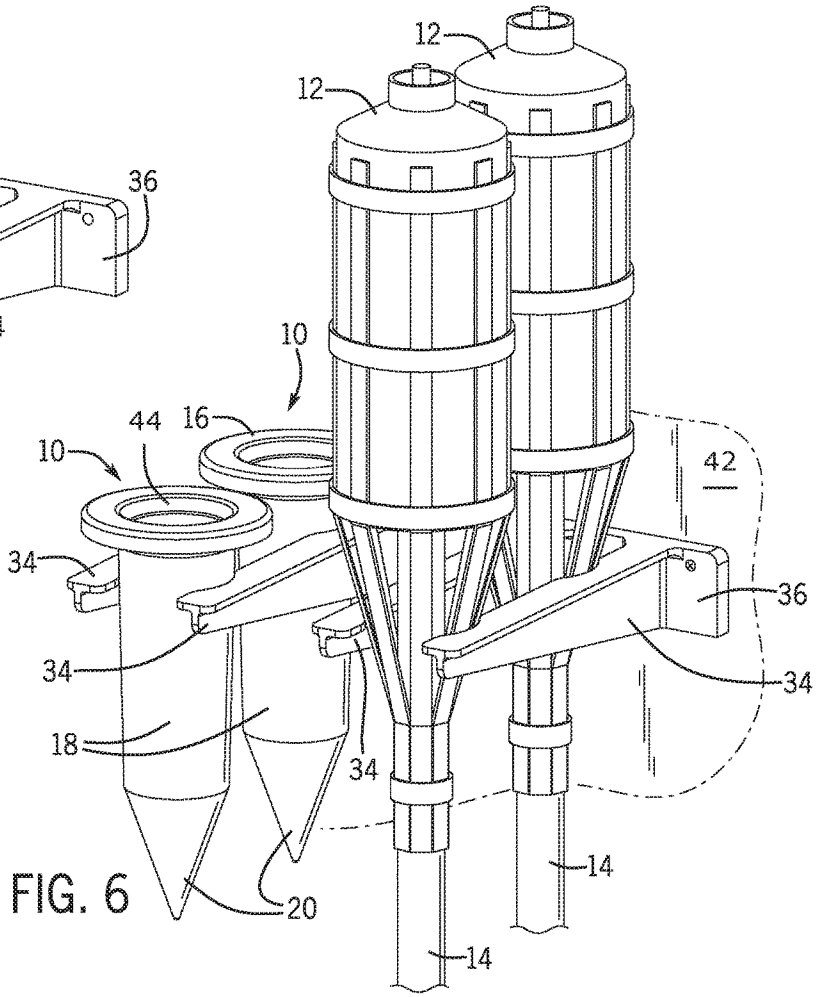
FIG. 6 is a perspective view of an exemplary embodiment of the present invention, showing the second storage rack in use.
Figure 5:
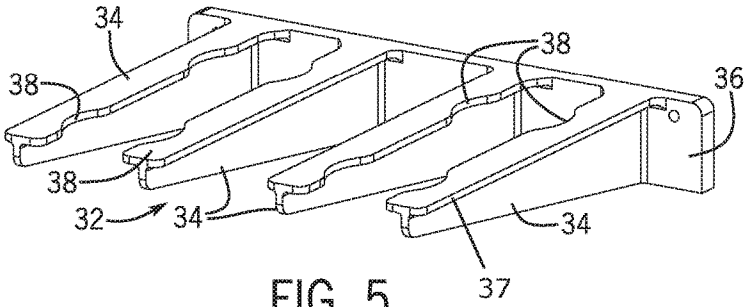
FIG. 5 is a perspective view of an exemplary embodiment of a second storage rack of the present invention.

The third torch holder 32 may provide a plurality of third arms 34 and extending generally perpendicularly from the planar mounting component 36, as illustrated in FIG. 5. Each third arm 34 may provide an upper flange 37 perpendicularly extending from an upper portion thereof, each upper flange 37 may provide U-shaped lateral notches 38 oriented to align and face U-shaped lateral notches 38 on adjacent third arms 34, as illustrated in FIG. 5. Thereby these pairs of aligned lateral notches 38 are dimensioned and adapted to engage opposing sides of the conic base 50 of the torch 12 or snugly engage the outer sidewalls of the cylindrical portion 18 of the first torch holder for removably retaining said torch 12 and said first torch holder 10 in a stored condition, as illustrated in FIG. 6.

A method of using the present invention may include the following. The first, second, and third torch holders 10, 24, and 32 disclosed above may be provided. A user desiring to plant a garden torch 12 in an operable condition may place the first torch holder 10 with the conic tip 20 pointed end down, and carefully step on the flange 16 until the first torch holder 10 is firmly secured in the horizontal supporting surface 40 to approximately the flange end 17. Then the user may plant the torch 12 into the first torch holder 10 through its opening 44, typically until the shaft 14 engages the ribs 22 of the tip portion 20. The first torch holder 10 is adapted to not wear out, and may be ready to be pulled up to move the torch 12 or store them.

When the user wishes to move the torch 12 to a stored condition, the user may secure either of the second and third torch holders 24 and 32 against the vertical supporting surface 42 by using fasteners through the respective mounting component 26 and 36. Then the user can support both the torch 12 and its first torch holder 10 by placing each in engagement with a pair of aligned upward-facing notches 30, a pair of aligned lateral notches 38, and/or a protrusion 28, respectively, as illustrated in FIGS. 4 and 6. The first, second, and third torch holders 10, 24, and 32 may be a kit.

It should be understood, of course, that the foregoing relates to exemplary embodiments of the invention and that modifications may be made without departing from the spirit and scope of the invention as set forth in the following claims.

What is claimed is:

1. A torch holder, comprising:

a hollow cylindrical portion extending from a flange end to a tip end, wherein the flange end defines an opening communicating to the hollow of the hollow cylindrical portion;

a flange radially extending from the flange end;

a hollow conical tip portion extending from said tip end along a longitudinal axis shared with the cylindrical portion; and a plurality of ribs protruding from an inward surface of said conical tip portion, wherein the plurality of ribs is spaced apart along the inward surface thereof for frictionally engaging and supporting a shaft of a torch in an upright orientation.

2. The torch holder of claim 1, further comprising a flange ridge extending perpendicularly from a distal end of the flange in the direction of the conical tip portion.

3. A kit for holding garden torches in a vertical supporting surface and a horizontal supporting surface, comprising:

a first torch holder of claim 1; and a second torch holder comprising:

an upward mounting portion;

at least one pair of upward notch arms extending from the upward mounting portion, each upward notch arm providing at least two spaced apart upward notches so that each pair of upward notch arms provides a plurality of pairs of upward notches, wherein each pair of upward notches is dimensioned to slidably receive a conical base portion of a garden torch;

a retainer arm extending from said upward mounting portion; and a plurality of protrusions extending upwardly from the retainer arm.

4. The kit of claim 3, wherein each protrusion is dimensioned to snugly engage said hollow of the hollow cylindrical portion.

5. The kit of claim 3, further comprising a third torch holder comprising:

a third torch holder comprising:

a lateral mounting portion;

a plurality of pairs of lateral notch arms extending from the lateral mounting portion, each lateral notch arm providing an upper flange perpendicularly extending from an upper portion thereof; and each upper flange providing a plurality of lateral notches so that each pair of lateral notch arms provides a plurality of pairs of facing lateral notches.

6. The kit of claim 5, wherein each pair of facing lateral notches is dimensioned to slidably receive either the cylindrical portion or a conical base portion of a garden torch.

7. A kit for holding garden torches in a vertical supporting surface and a horizontal supporting surface, comprising:

a first torch holder of claim 1; and a lateral mounting portion;

a plurality of pairs of lateral notch arms extending from the lateral mounting portion, each lateral notch arm providing an upper flange perpendicularly extending from an upper portion thereof; and each upper flange providing a plurality of lateral notches so that each pair of lateral notch arms provides a plurality of pairs of facing lateral notches.

8. The kit of claim 7, wherein each pair of facing lateral notches is dimensioned to slidably receive either the cylindrical portion or a conical base portion of a garden torch.

* * * * *